166-66 SR
2/21/78 XR 4,074,756

United States Patent [19]

Cooke, Jr.

[11] 4,074,756

[45] Feb. 21, 1978

[54] APPARATUS AND METHOD FOR WELL REPAIR OPERATIONS

[75] Inventor: Claude E. Cooke, Jr., Houston, Tex.

[73] Assignee: Exxon Production Research Company, Houston, Tex.

[21] Appl. No.: 759,941

[22] Filed: Jan. 17, 1977

[51] Int. Cl.[2] ..... E21B 33/13; E21B 43/119; E21B 47/06

[52] U.S. Cl. ..... 166/253; 166/55.1; 166/64; 166/66; 166/277; 166/285; 166/297

[58] Field of Search ..... 166/250, 253, 64, 65 R, 166/66, 277, 285, 286, 290, 297, 55, 55.1

[56] References Cited

U.S. PATENT DOCUMENTS

| | | | |
|---|---|---|---|
| 2,451,520 | 10/1948 | Teplitz | 166/253 |
| 2,842,205 | 7/1958 | Allen et al. | 166/285 |
| 3,426,849 | 2/1969 | Brumble, Jr. | 166/297 X |
| 3,815,677 | 6/1974 | Pennebaker, Jr. | 166/253 |
| 3,967,681 | 7/1976 | Curzon | 166/277 |

FOREIGN PATENT DOCUMENTS

| | | | |
|---|---|---|---|
| 864,221 | 2/1971 | Canada | 166/253 |

*Primary Examiner*—Stephen J. Novosad
*Attorney, Agent, or Firm*—Michael A. Nametz

[57] ABSTRACT

Flow channels behind the casing in a well are plugged by detecting a circumferential temperature anomaly on the casing, perforating in the direction of such anomaly, and introducing cement into the perforations. The apparatus for locating and perforating into a flow channel includes a sensitive temperature sensing assembly capable of detecting temperature differences as low as 0.01° F, and an attached perforating gun having a fixed orientation in relation to the temperature sensing assembly.

15 Claims, 6 Drawing Figures

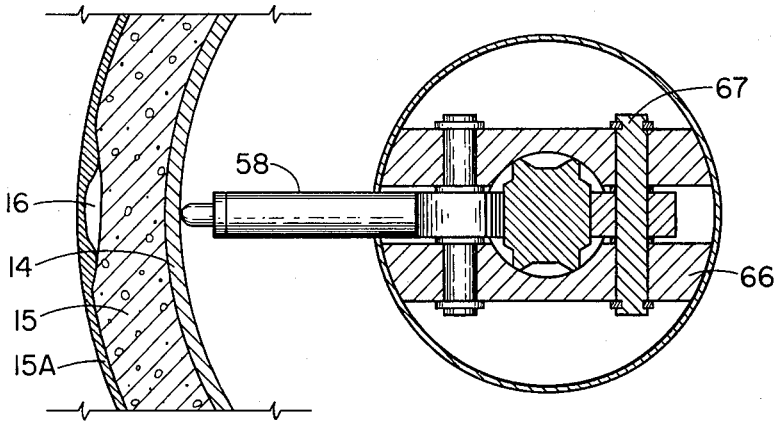
FIG. 3
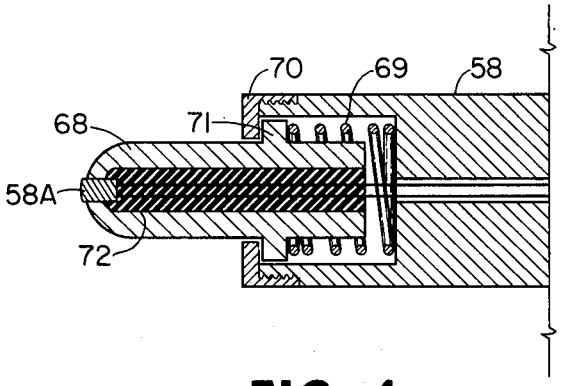
FIG. 4
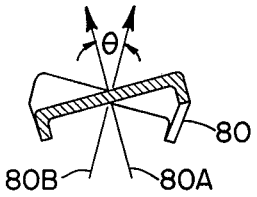
FIG. 5
FIG. 6
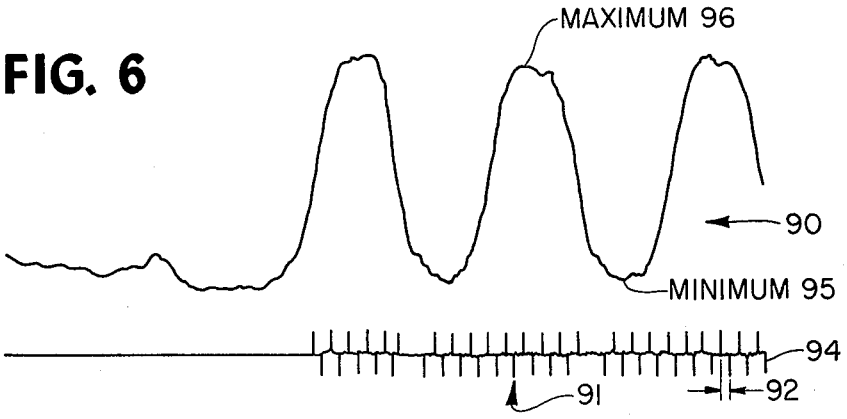

APPARATUS AND METHOD FOR WELL REPAIR OPERATIONS

BACKGROUND OF THE INVENTION

1. Field of the Invention

This invention relates to apparatus and methods for repairing a well. More specifically, this invention relates to apparatus and methods for locating, perforating into and plugging a flow channel outside the casing in a well.

2. Description of the Prior Art

In completing a well, a casing string is typically introduced into the wellbore and cemented into place. In addition to providing physical support of the wellbore, a major purpose of the casing is to prevent communication of fluids between subterranean formations. Often, however, fluid communication between formations results after cementing operations are completed because of the presence of longitudinal channels in or next to the cement sheath.

During a cementing operation, cement channels are frequently formed when the cement slurry fails to uniformly displace the drilling and from all parts of the annulus between the casing and the wellbore. These channels in the cement sheath or in the remaining gelled mud, provide paths for fluid communication between the desired hydrocarbon producing zone and a zone containing water or gas. Such fluid communication may cause several problems, including a reduced producing rate as well as water and gas separation problems afterwards.

To prevent interzone fluid flow, an attempt is usually made to repair the well by a technique known as "squeeze cementing". Squeeze cementing involves randomly perforating the casing at depth in the well where the channel is believed to exist, and injecting cement under pressure into the resulting perforations with the hope that the cement enters and plugs the channel.

A problem associated with squeeze cementing techniques has been that of precisely locating the flow channel. A variety of well logging techniques, including temperature logging, sound logging and radioactive logging methods, have been used in determining the vertical location of a flow channel, but have not been used to determine the precise circumferential location about the casing.

It is presently believed that many channels behind casing exist as relatively narrow channels, such that random perforation according to prior art techniques may not penetrate the channel. Thus, most of the prior methods for plugging channels behind casing often fail to stop fluid communication between zones because the precise location, i.e. a circumferential direction, of the channel is not known. Merely locating a channel at a given depth does not ensure that the channel will be penetrated upon perforation of the casing.

SUMMARY OF THE INVENTION

This invention relates to a method and apparatus for locating the relative circumferential direction of a flow channel behind casing at a given depth, and perforating into the flow channel in the indicated direction, thereby permitting the flow channel to be plugged with cement. The detection of the circumferential direction of a channel and perforating into the channel are accomplished using, in combination, a rotatable temperature sensing assembly, and a perforating gun. The invention allows the channel to be perforated without removing the temperature sensing device from the well, and also eliminates the need for employing any absolute direction indicating means. The azimuth of the channel, i.e., the horizontal angular distance from a fixed reference direction to the channel, need not be obtained.

In a preferred embodiment, the temperature sensing assembly includes a plurality of temperature sensing probes, and the perforating gun contains a plurality of charges spaced longitudinally to form a helical firing pattern.

The method involves lowering the apparatus into a zone of interest by means of a multi-conductor cable. The temperature sensing probes contact the casing wall at circumferentially spaced points, and are caused to rotate around the axis of the casing at a given depth. Differential temperature measurements are made and recorded as a function of circumferential direction. Thus, an accurate representation of the circumferential temperature gradient existing at a given depth within the well may be determined. Such a temperature gradient indicates the relative circumferential direction of a channel behind a casing and consequently the direction in which a perforating gun should be discharged to penetrate the channel. The perforating gun, which is attached directly to the temperature sensor assembly, has a fixed orientation with respect to the temperature sensing probes. The perforating gun is discharged in the direction of a channel, as indicated by the recorded temperature gradient. Penetration into the channel is insured, since perforation is controlled and directed toward a known channel. This is accomplished without removing the apparatus from the well, and without using an orienting device. Subsequently, the channel is flushed with appropriate fluids and cement is introduced through the perforations into the channel and allowed to set, thereby plugging the channel.

The invention relies, in part, on the discovery that flow of fluids in a channel results in a circumferential temperature anomoly that can be detected with instruments. For detecting gas or water flow the instrument should be capable of detecting temperature differences between about 0.01° F and about 0.2° F.

DESCRIPTION OF THE DRAWINGS

FIG. 3 is a fragmentary, cross-sectional view of the temperature sensor assembly taken generally along the Section 3—3 of FIG. 1 illustrating one probe assembly and the channel behind the casing.

FIG. 4 is a sectional view illustrating details of a portion of the probe assembly shown in FIG. 3.

FIG. 5 is a schematic sectional view of the perforating gun assembly taken along the Section 5—5 of FIG. 1 illustrating the helical firing pattern.

FIG. 6 is an actual temperature log illustrating the circumferential temperature gradient curve obtained at a given vertical depth in a well having a gas channel.

DESCRIPTION OF THE PREFERRED EMBODIMENT

Figure 1:
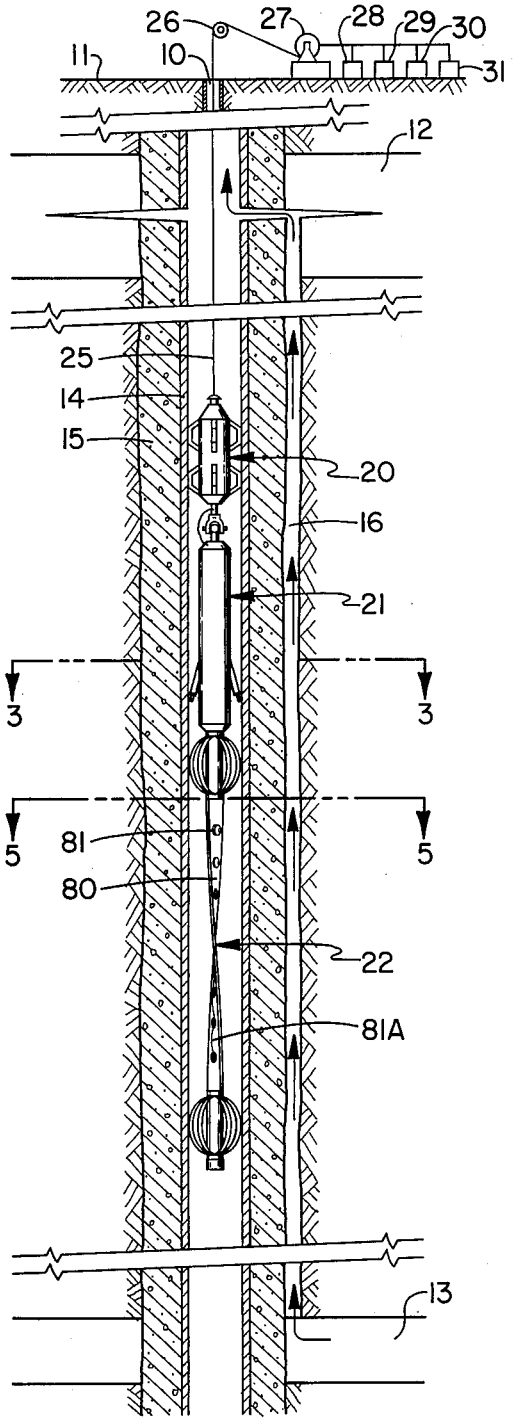
FIG. 1 is a schematic view of a well repair operation illustrating one embodiment of the apparatus of this invention.

Referring to FIG. 1 of the drawings, a well 10 extends from the surface of the earth 11 and penetrates subsurface formations 12 and 13. (Note that the lower portion of the well in FIG. 1 has been expanded to illustrate details of the apparatus.) A casing string 14 has been introduced into the borehole and cemented into place, providing a cement sheath 15. A flow channel 16 (exaggerated) is shown to illustrate the path of fluid communication.

The apparatus for locating and perforating into flow channel 16 includes three major components: a rotator assembly 20, a temperature sensing assembly 21, and a perforating gun assembly 22.

The three components, assembled as illustrated, are lowered into the well 10 on a multi-conductor electrical cable 25. The multi-conductor cable 25 moves over a suitable pulley 26 at the wellhead and a cable drum 27 raises and lowers the apparatus as desired. Suitable electrical signals from the downhole apparatus are transmitted to the rotator assembly control 28, the temperature sensor motor control 29 and the temperature sensor output analyzer 30. A perforating gun discharge control 31 is also connected by means of the multi-conductor cable 25 to the perforating gun assembly 22.

Figure 2:
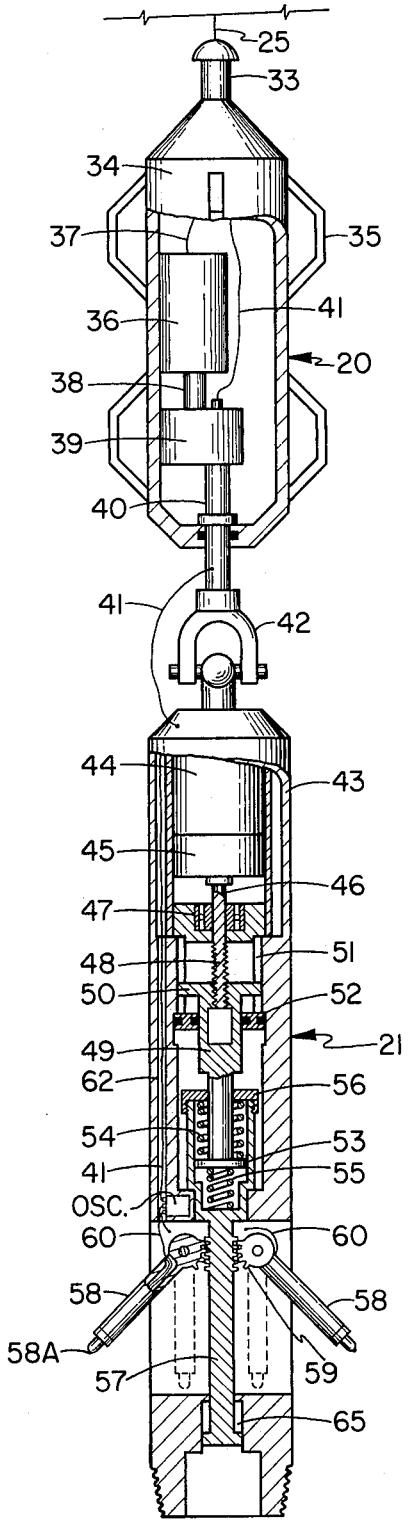
FIG. 2 is a longitudinal sectional view of the rotation assembly and temperature sensing assembly shown in FIG. 1.

Referring to FIG. 2, the rotator assembly 20 is provided with a fishing neck 33 through which the multi-conductor cable 25 passes. The rotator housing 34, shown cutaway, has centralizers 35 suitably attached to its external surface to minimize rotation of the exterior of the assembly. Mounted within the housing 34 is a reversible electric motor 36 which is powered by the surface motor control 28 through cable 25 and leads 37. The output shaft 38 of motor 36 is connected to a suitable power transmission assembly 39, such as a gear box, and serves to rotate the temperature sensing assembly 21 and perforating gun assembly 22.

A cable 41 passes through shaft 40 and electrically interconnects with cable 25 and the temperature sensor assembly 21. The power transmission output shaft 40 of the rotator assembly 20 is connected to the temperature sensing assembly 21 by a suitable flexible joint 42. Thus, when the rotator motor 36 is actuated by the operator at the surface motor control 28, the temperature sensing assembly 21 will rotate about its vertical axis. The rotator assembly 20 will tend to remain stationary due to the frictional contact of the centralizers 35 on the casing wall.

The temperature sensing assembly 21 includes a plurality of temperature probes 58 and electrically powered transmission means for moving the probes from a retracted, running-in position to an extended, operating position.

The temperature sensing assembly 21 is provided with an external housing 43 which couples at its lower end with the perforating gun assembly 22. At the upper end of the external housing 43 there is suitable opening through which the multi-conductor cable 41 passes. Suitable leads from the multi-conductor cable 41 are provided for powering the electrical reversible temperature sensor motor 44 which supplies rotary power to a suitable power transmission 45. The power transmission output shaft 46 is journaled by bearings 47 and has a threaded lower end 48. A connecting member 49 has a threaded central bore which mates with the threaded lower end of the power output shaft 48. Keys 50 are provided at the upper end of the connecting member 49 which ride in key slots 51. Thus, rotation of the output shaft 46 causes vertical movement of the connecting member 49 since rotational motion of the member is prevented by keys 50 and slots 51. Hydraulic seals 52 are provided on the exterior of the connecting member 49 to prevent entry of well fluids into the temperature sensor motor 44 and power transmission 45.

The lower end of connecting member 49 is provided with a flange 53 which bears against spring 54 and spring 55. The springs 54 and 55 provide a proper dampening action to movement of the connecting member 49 and prevent overpowering motor 44. The connecting member 49 passes through a suitable central opening in the cover member 56 which is threadably connected to rack member 57. As the connecting member 49 moves upward due to rotation of the power output shaft 46, spring 54 will compress and bear against the cover member 56. This upward force will cause the rack member to move vertically upward and move the probe assembly 58 to its retracted position as shown by the dotted lines in FIG. 2 through the action of the pinion gear 59 and the rack on the rack member 57. As the connecting member moves down, the probe assembly will move to the extended position as shown in FIG. 2 in a similar manner. The lower end of the rack member 57 is provided with a protection stop 65 in a suitable slot to prevent override of the rack and pinion gearing. A similar stop is provided by the abutment of the rack member 57 with the housing 43 at a point above the probe assemblies.

The preferred embodiment of the temperature sensor assembly has two probe assemblies 58 disposed 180° apart about the vertical axis of the temperature sensing assembly 21. As shown in FIG. 2, each probe assembly 58 contains a temperature sensor, one of which is shown as 58A, which is electrically connected with an oscillator (OSC). The temperature sensors are of the resistance type, such as thermistors; the oscillator is of the resistance controlled pulse type such as the unijunction relaxation type. Variations in the frequency of the oscillator are directly proportional to differences in resistance between temperature sensors, and hence proportional to temperature differences between opposite points on the casing.

FIG. 3 shows the relative positions of the two probes 58 in the temperature sensor. For clarity, one of the probes is shown in its extended position; however, it should be understood that in operation both probes will be in the same position. The probe 58 is shown touching the wall of the casing string 14, next to a flow channel 16 in the cement sheath 15 and solidified drilling mud sheath 15A. The probes 58 are mounted on the probe assembly yoke 66 by bearing 67 to permit movement between their extended and retracted positions. The yoke 66 may be an integral part of the housing 43.

As best seen in FIG. 4, the probe 58 terminates in probe tip 68 which must have a high thermal conductivity. The material of probe tip 68 may be metallic, such as a suitable nickel alloy. A biasing spring 69 forces the tip 68 outward relative to the probe 58, and assures proper contact of all probe tips with the wall of the well. The probe tip 68 is secured within the probe by cap 70 and flange 71. Temperature sensor 58A is positioned in a central bore in the probe tip 68 and secured in the tip by an electrically insulating potting material 72 having a high thermal conductivity such as an epoxy resin.

As shown in FIGS. 1 and 2, from each probe, a conductor 60 is electrically connected with the oscillator. The output from the oscillator is connected via multi-conductor cable 41, which passes through one of the slots 62 in the temperature sensor housing, brushes in pulley 26, and multi-conductor cable 25 to output analyzer 30. In the output analyzer 30, the oscillator output is connected to an input of a counting rate meter. The counting rate meter is connected with a differential amplifier. The differential amplifier generates an output signal directly proportional to the output signal from the counting rate meter, which is proportional to the frequency of the oscillator and therefore proportional to the temperature difference between the temperature sensors. The output of the differential amplifier is connected to a recorder, which provides a continuous recorded display of the temperature differences relative to rotation of the probes. The radial direction of the probes relative to a fixed point, e.g. compass direction, is not recorded.

Referring to FIG. 1, the perforating gun assembly 22 is fixedly attached to, and aligned with, the temperature sensing assembly 21 and includes a long, thin, rectangular steel strip 80 in which a number of circular mounting bores have been drilled. These bores are evenly spaced and centered on the longitudinal axis of strip 80. Further, in constructing the perforating gun assembly 22 the steel strip 80 has been twisted around its vertical, central axis. As may be seen more clearly in FIG. 5, twisting the steel strip results in the lowermost bore being disposed at an angle $\theta$ relative to the uppermost bore. Vectors 80A and 80B represent the firing direction of the upper- and lowermost charges to illustrate the angular separation of charges. The remaining bores are evenly spaced angularly between the direction of the uppermost and lowermost bores. In the preferred embodiment, eight bores are provided and the angle $\theta$ is equal to 30°. The angle $\theta$ could be as small as 0°, as where strip 80 is not twisted at all, or as large as 60°. However, since some channels may not be uniformly vertical, the angle $\theta$ should be at least 20° to assure penetration of a channel. As shown in FIG. 1, charges 81 are mounted in the bores and are electrically interconnected by means of detonating wire 81A.

The spacing and orientation of charges 81 are such that, when fired, a helical pattern of perforations over an angular range of $\theta$ is formed in the casing. Moreover, the direction of the charges 81 has a fixed orientation with respect to the temperature sensor assembly, and therefore the mean circumferential direction of the perforations may be controlled relative to the angular orientation of the temperature sensing assembly 21. The perforating gun assembly 22 is suitably connected electrically through the temperature sensor assembly to the multi-conductor cable, and the firing of the charges 81 is controlled by means of the perforating gun discharge control 31.

In operation, the apparatus which includes assemblies 20, 21 and 22 is lowered into the cased wellbore on cable 25 to the desired vertical depth opposite the flow channel. A rough indication of the depth of the flow channel 16 may be previously determined through the use of conventional logging techniques, such as sound logs ("noise" logs) or vertical temperature logs. While lowering the apparatus 19 into the well, probe assemblies 58 are retracted, as shown by the dotted lines in FIG. 2. Upon reaching the pre-determined depth, the probe assemblies are extended to contact the wall of casing string 14 at the approximate vertical depth on its circumference indicated by the preliminary logging step. This is accomplished by actuation of the temperature sensor motor control 29 at the surface. Rack member 57 is caused to move downward as previously described, pushing the probes 58 against the wall of casing string 14.

When a probe assembly tip 68 contacts a point on the casing wall having a given temperature, a change in the frequency of the oscillator (OSC) will be induced due to the change in the resistances of the temperature sensors. The output will be transmitted to the output analyzer 30 at the surface by means of the multi-conductor 25, and a suitable signal is produced, as previously described, from which a strip chart recording may be made.

During rotation around the axis of the wellbore, the difference between resistances of the probes will vary in proportion to temperature difference. The temperature difference with respect to circumferential rotation is then recorded. An example of such a recording is shown in FIG. 6, in which the abscissa represents the change in the angular orientation of the temperature sensing assembly 21 and perforating gun assembly 22 during rotation and the ordinate represents the temperature difference. Curve 90 is a plot of the differential temperature distribution. The distance 92 between each mark on rotation index 91 represents an angular change of 18° in the circumferential direction of assemblies 21 and 22 around the longitudinal axis of the casing.

Upon reaching the desired vertical depth, the initial circumferential direction of a probe assembly 58 around the axis of the wellbore becomes an arbitrary reference point, represented by mark 94 on index 91, from which angular changes during rotation around the casing axis are measured. When rotating, the extent of angular change with respect to the reference point is recorded. This is accomplished simply by recording a mark each time the temperature sensing assembly 21 and perforating gun assembly 22 have rotated through a conveniently fixed angle, in FIG. 6 equal to 18°. Thus, the total angular change in orienting the temperature sensing assembly 21 and perforating gun assembly in the direction of minimum 95 is approximately 300°, while orienting in the direction of maximum 96 requires an angular change of about 480°. Generally, the fixed angle measured can be multiplied by an integer so that rotation through 360° can be repeated and correlated with the recorded temperature distribution pattern. For each rotation through 360°, the same differential temperature recording is repeated. Significantly, it is not necessary to indicate the absolute orientation of the probes. The temperature distribution over any given angular range of rotation is recorded providing curve 90.

An important requisite of the temperature sensing assembly 21 is the ability to detect small differences in temperature. Although fluid flow through a channel often causes fairly large vertical deviations in temperature, only minor deviations exist around the circumference of the casing at a given vertical depth. The temperature sensing assembly of the present invention has been designed with the capability of detecting temperature difference as small as 0.01° F, significantly smaller than detectors used in vertical temperature logging. Tests have been performed indicating that the circumferential temperature difference due to a gas or water flow channel generally is within the range of about 0.01° F to about 0.2° F. It has further been demonstrated that the temperature sensing assembly of the present invention can successfully and accurately detect the presence of either fluid flowing in a channel. For example, the temperature difference indicated by minimum 95 and maximum 96 of FIG. 6 is 0.15° F.

In curve 90, maximum 95 and minimum 96 indicate the existence of a flow channel. Whether water or gas is flowing between zones is generally known from the production characteristics of the well. Usually, when water is flowing upward in the channel, the casing wall directly adjacent will have a higher temperature than the temperature of the casing wall that is not adjacent to the flow channel (a "hot" flow channel). If the temperature of the casing wall varied evenly, the highest temperature would be opposite the flow channel and the lowest temperature would be diametrically opposed to the flow channel. In the case of gas flow, the portion of the casing wall next to the flow channel would generally have a lower relative temperature (a "cold" flow channel). This is because as gas flows through the channel, the gas is cooled due to the Joule-Thompson effect.

The output from the oscillator is connected to output analyzer 30 in such a manner that the relative circumferential direction of a "hot" flow channel is recorded as maximum, whereas that of a "cold" flow channel is recorded as minimum. In FIG. 6, the presence of a gas channel was detected, and hence minimum 95 indicates the proper orientation of the perforating gun 22 for firing.

As previously indicated, the perforating gun 22 is aligned with and has a fixed orientation relative to the temperature sensing assembly 21. In general, the perforating gun assembly 22 is attached so that the mean circumferential direction of perforations, when the charges of the perforating gun are fired, will be about the same as the direction of a single probe 58. The probe with which the gun is aligned depends on whether a "hot" or "cold" flow channel exists. Referring to FIG. 5, when properly aligned, the perforating charges will be circumferentially spaced over a total angular range of $\theta$.

Perforating gun assembly 21 is oriented in the direction of the flow channel by rotating until the appropriate maximum or minimum is reached, as indicated by curve 90. The apparatus may then be raised a predetermined distance corresponding to the distance between the longitudinal center of the perforating gun and the probe tips, and the perforating gun fired. However, since a flow channel is typically much longer vertically than the length of the apparatus such upward movement is often unnecessary. The flow channel is generally uniformly vertical over this relatively small distance. Thus, even without movement, the perforating gun may be oriented such that when fired a helical pattern of perforations will penetrate the flow channel. Further, even if a channel is not uniformly vertical, the helical pattern of perforations ensures penetration of the channel.

Once penetration into the flow channel is accomplished, the channel may be plugged using squeeze cementing techniques well known to those skilled in the art.

Various other techniques may be employed when performing the method of this invention. When the two zones in fluid communication are closely spaced vertically, the temperature of the casing wall next to the channel may be virtually equivalent to the temperature of the remaining casing wall at the same vertical depth. Thus, it may be difficult to obtain a significant amplitude in the recorded temperature distribution to enable orientation of the perforating gun assembly 22. In this situation, the apparatus may be set near the existing casing perforations in communication with the flow channel and cool surface water pumped into the wellbore. The water is forced under pressure into the existing perforations and eventually into the flow channel. Temperature measurements may be made during water pumping. When cool water is forced into the channel, a larger temperature differential will exist between probes than those described above. The recorded temperature distribution at the surface may be used as before to determine the proper orientation of the perforating gun.

If the apparatus or method of the present invention is used in multiple tubing completions it may be necessary to utilize, in combination with components 20, 21, and 22, a device for detecting a tubing string in order to avoid perforating such tubing string. A radioactive detector may be attached to the apparatus. A radioactive source may then be lowered into the adjacent tubing to the same vertical depth as the detector. The temperature distribution may be recorded and the perforating gun oriented as before, except that the radioactive detector provides an indication of the direction of the adjacent tubing. Correlating this information with the temperature distribution allows perforation into the flow channel to be accomplished without penetration into adjacent tubing. Note that this may require orienting the perforating gun in a circumferential direction that is slightly different than the direction of the flow channel as indicated by the differential temperature recording.

In another form, the apparatus may utilize more than two probes. However, the temperature distribution recorded at the surface would be more difficult to interpret in orienting the perforating gun, since multiple differential temperatures at a given perforating gun direction would be recorded rather than one.

A single probe assembly touching the wall of the casing may also be employed. Such an apparatus would measure the differential temperature between the casing and a probe near the center of the casing at a given vertical depth. This will sometimes aid in determining the nature of fluid flowing in the channel, i.e., gas or water flow. Use of this apparatus would be a primary advantage where the identity of the fluid flowing in the channel was unknown.

Any convenient device for rotating the apparatus of this invention may be used. In lieu of the motor driven device of the preferred apparatus, a hydraulically actuated device as illustrated in U.S. Pat. No. 3,426,851 or mechanically actuated devices as illustrated in U.S. Pat. No. 2,998,068 of U.S. Pat. No. 3,426,849 might be employed. Also thermal measuring devices other than thermistors might be employed, such as thermocouples.

A preferred apparatus and mode of practicing the invention have been described. It is to be understood that the foregoing is illustrative only and that other means and techniques can be employed without departing from the true scope of the invention defined in the following claims.

What is claimed is:

1. An apparatus adapted to be lowered into a well for locating and perforating into a flow channel located outside the well casing which comprises:

temperature sensing means adapted to measure a temperature distribution around the circumference of said casing at a given vertical depth, thereby detecting said flow channel;

a perforating gun directly attached to, and having a fixed angular orientation with respect to said temperature detecting means; and means for firing said gun with said gun oriented generally in the direction of said flow channel.

2. The apparatus as defined in claim 1 wherein said temperature sensing means include a plurality of temperature probes which are adapted to contact the wall of said casing for measuring differential temperatures on the casing wall at circumferentially spaced points.

3. The apparatus of claim 2 wherein said perforating gun contains a plurality of charges vertically spaced such that when said gun is fired a helical pattern of perforations is formed in said wall.

4. The apparatus of claim 3 wherein said pattern is formed over a circumferential angular range of between about 20 and about 60 degrees on said casing.

5. The apparatus as defined in claim 4 wherein said gun is oriented with respect to one of said probes, said one probe being directed radially outwardly towards the angular midpoint of said circumferential angular range.

6. The apparatus of claim 5 wherein said perforating gun includes a thin rectangular metal strip having bores along its longitudinal axis, said charges being mounted in said bores, and said strip being twisted around said axis to define said circumferential angular range.

7. The apparatus of claim 2 wherein said probes have a normal retractable position and wherein said apparatus further includes means for extending said probes into contact with said casing.

8. The apparatus of claim 1 wherein said temperature sensing means is capable of detecting a temperature difference of between about 0.01° F and about 0.2° F.

9. An apparatus adapted to be lowered into a cased well for perforating into a flow channel behind casing, the apparatus comprising:

a rotatable temperature sensing assembly including at least two diametrically arranged probes for detecting temperature differences on the wall of said casing at diametrically opposite locations at about the same vertical depth in said well, thereby indicating the circumferential direction of said channel; and a perforating gun attached directly to, and aligned with, one of said probes such that the firing pattern of said gun is in the outward, circumferential direction of said one probe.

10. A method of repairing a cased well having a flow channel adjacent to the casing which comprises orienting a perforating gun in the direction of said channel by determining the greatest temperature anomaly around the circumference of said casing, said greatest temperature anomaly providing an indication of the direction of said channel; discharging said perforating gun in the general direction of the greatest temperature anomaly, thereby penetrating said flow channel with perforations; and introducing cementitious material into said perforations and said flow channel to plug said flow channel.

11. The method of claim 10 wherein said greatest temperature anomaly around the circumference of said casing is determined by recording the difference in temperature between multiple opposite points on the circumference of said casing.

12. The method of claim 11 wherein said recording is obtained by rotating around the axis of said well a device having two opposite temperature sensing probes which contact the wall of said casing at about the same vertical depth.

13. A method of perforating into and plugging a flow channel outside a casing in a well which comprises, lowering into said well a perforating apparatus capable of measuring a temperature differential between at least two points on said casing at substantially the same vertical depth in said well;

measuring said temperature differential circumferentially around said casing at said vertical depth to detect temperature differences in the range of about 0.01° F to about 0.2° F, thereby indicating the circumferential direction of said channel;

perforating said casing in said circumferential direction of said channel;

removing said apparatus from said well; and plugging said channel with cement.

14. The method of claim 13 wherein said casing is perforated in the circumferential direction indicated by the greatest difference in temperature between opposite points on said casing.

15. The method of claim 14 which further includes introducing water at surface temperature into said well prior to measuring said temperature differential.

* * * * *